US005957190A

United States Patent [19]

Morishita et al.

[11] Patent Number: 5,957,190

[45] Date of Patent: Sep. 28, 1999

[54] METHOD OF INTEGRALLY ATTACHING HOLLOW MEMBER TO CAST PRODUCT BY CASTING AND APPARATUS THEREFOR

[75] Inventors: Hisaya Morishita; Akira Seki, both of Toyota; Shigeki Tamura, Aichi-ken; Mitsuru Inui, Gifu, all of Japan

[73] Assignee: Toyota Jidosha Kabushiki Kaisha, Japan

[21] Appl. No.: 08/922,341

[22] Filed: Sep. 3, 1997

[30] Foreign Application Priority Data

Sep. 4, 1996 [JP] Japan ..... 8-234319

[51] Int. Cl.[6] ..... B22D 19/00

[52] U.S. Cl. ..... 164/112; 164/98; 164/137; 164/332

[58] Field of Search ..... 164/98, 112, 132, 164/137, 332

[56] References Cited

U.S. PATENT DOCUMENTS 5,305,818 4/1994 Darsy et al. ..... 164/98

FOREIGN PATENT DOCUMENTS 57-51576 3/1982 Japan ..... 164/112
57-56147 4/1982 Japan .
62-21453 1/1987 Japan .
62-21454 1/1987 Japan .
63-97348 4/1988 Japan ..... 164/98
2-63670 3/1990 Japan ..... 164/332
3-248760 11/1991 Japan ..... 164/112
4-305351 10/1992 Japan ..... 164/98
879287 10/1961 United Kingdom ..... 164/112

*Primary Examiner*—J. Reed Batten, Jr.
*Attorney, Agent, or Firm*—Finnegan, Henderson, Farabow, Garrett & Dunner, L.L.P.

[57] ABSTRACT

In a method of integrally attaching a hollow member to a cast product by casting so that the hollow member communicates with a hollow interior of the cast product, a closure member is fitted into an open end of the hollow member so that the open end of the hollow member is closed by the closure member. The closure member projects from a core for forming the hollow interior of the cast product in a direction different from a direction in which the core is drawn out of the cast product. A molten metal is poured into a casting mold after the casting mold has been clamped. The closure member is moved inside the core after solidification of the molten metal so that the closure member is released from the fitting in the hollow member. The core is drawn out of the solidified metal subsequently to the moving step of the closure member.

9 Claims, 11 Drawing Sheets

46
26
16h
46a
D
C
16s
16
46b
36
16d
16f
16w
2a
2b
46e
46j
46f
46k
16w
16

METHOD OF INTEGRALLY ATTACHING HOLLOW MEMBER TO CAST PRODUCT BY CASTING AND APPARATUS THEREFOR

BACKGROUND OF THE INVENTION

1. Field of the Invention

This invention relates generally to a technique for casting a product in which a cast product is integral with a hollow member. In the technique, the hollow member is previously positioned in a casting mold and casting operation is thereafter performed such that the product in which the cast product is integral with the hollow member is cast. More particularly, the invention relates to a technique for casting a product wherein a cast product has a hollow interior with which a hollow member communicates. Casting a product in which a cast product is integral with a hollow member previously positioned in a casting mold will hereinafter be referred to as "integrally attaching the hollow member to the cast product by casting" in the description. The invention relates to a method of integrally attaching a hollow member to a cast product by casting and an apparatus therefor.

2. Description of the Prior Art

Japanese patent publication No. 62-21454 (1987) discloses a conventional method of integrally attaching a hollow member to a cast product. In the disclosed method, both ends of the hollow member is fixed by a casting mold so that the hollow member is positioned with respect to the casting mold and so that a molten metal is prevented from penetrating the hollow member. The casting operation is performed in this condition. Japanese patent publication No. 57-56147 (1982) discloses another method in which a core is provided in the hollow member so that the latter is prevented from collapse during the casting operation A cast product with a hollow interior is thus produced by each of the above-described conventional techniques. FIG. 18 illustrates a product W in which a cast product c is integral with a hollow member h. The product W is provided with a hollow interior ws.

However, a method has not been developed of integrally attaching a hollow member 2 to the cast product c so that the hollow member 2 communicates with the hollow interior ws of the cast product C as shown in FIG. 17. In the status of the prior art, accordingly, the cast product c is first cast and the hollow member 2 is thereafter fixed to the cast product c.

SUMMARY OF THE INVENTION

Therefore, an object of the present invention is to accomplish a new technique capable of producing a product W in which the hollow member 2 communicating with the hollow interior ws of the cast product c is integrally attached to the cast product c so as to be integral therewith. The step of fixing the hollow member 2 to the cast product c can be eliminated when the method is accomplished.

In this method, ends 2*s* of the hollow member 2 need to be disposed in a cavity defined by a casting mold in order that the hollow member is integrally -attached to the cast product c so as to communicate with the hollow interior ws of the cast product c. Open ends 2*h* of the hollow member 2 need to be closed by closure members etc. so that molten metal is prevented from penetrating the interior of the hollow member. Furthermore, a core (not shown in FIG. 17) needs to be set in a casting mold so that the cast product c with the hollow interior ws is cast. In view of the above-described circumstances, the closure members to be fitted in the respective open ends 2*h* of the hollow member 2 to close them need to be attached to a surface of the core so that the above product is produced by casting.

However, the core cannot be drawn out of the cast product c in the case where the closure member attached to the surface of the core is fitted in the open end 2*h* of the hollow member 2. In this case, a use of a sand core can be considered. However, the use of the sand core requires breaking the sand core and taking it out of the cast product c at a subsequent step, resulting in troubles and an increase in the production cost.

Therefore, another object of the invention is to solve the above-described problem by providing a measure wherein the closure member fitted in the open end of the hollow member to close the open end during the casting operation permits the core to be drawn out of the cast product when the casting mold is opened and the core is drawn out of the cast product.

In one mode of the invention, a closure member to be fitted in an open end of a hollow member is movable between a fitted position and a non-fitted position so that a core can be drawn out without interference between the hollow member and the closure member when the casting mold is opened. A mechanism for moving the closure member is preferably simple and compact in structure. Various types of mechanism are developed in accordance with the invention.

Another mode of the invention realizes a structure permitting the core to be drawn out with the closure member being fixed at a certain position.

Further another mode of the invention realizes a structure in which the core is directly fitted in the open end of the hollow member to close it and can be drawn out when the casting mold is opened.

In the above-mentioned one mode, the invention provides a method of integrally attaching a hollow member to a cast product by casting so that the hollow member communicates with a hollow interior of the cast product, the method comprising the steps of:

fitting a closure member into an open end of the hollow member so that the open end of the hollow member is closed by the closure member, the closure member projecting from a core for forming the hollow interior of the cast product in a direction different from a direction in which the core is drawn out of the cast product;

pouring a molten metal into a casting mold after the casting mold has been clamped;

moving the closure member inside the core after solidification of the molten metal so that the closure member is released from the fitting into the hollow member; and drawing the core out of the solidified metal subsequently to the moving step of the closure member.

According to the above-described method, the closure member is fitted in the open end of the hollow member to thereby close the same. Casting operation is performed under this condition. Consequently, the molten metal can be prevented from penetrating the hollow member. Furthermore, the hollow member can be positioned with respect to the casting mold by the closure member. The closure member is moved away from the hollow member to be released from the fitting in the open end of the hollow member after the molten metal has been solidified. Accordingly, the core can be drawn out. Consequently, even when the open end of the hollow member needs to be disposed in the cavity defined by the casting mold, the hollow member can be integrally attached to the cast product so that the molten metal is prevented from penetrating the hollow member. Furthermore, the core can be drawn out without being obstructed by the closure member used for closing the open end of the hollow member. Various types of apparatus for carrying out the above-described method have been developed.

In the above-mentioned another mode, the invention provides a method of integrally attaching a hollow member to a cast product by casting so that the hollow member communicates with a hollow interior of the cast product, the method comprising the steps of:

fitting a closure member into an open end of the hollow member so that the open end of the hollow member is closed by the closure member, the closure member projecting from a core for forming the hollow interior of the cast product in a direction different from a direction in which the core is drawn out of the cast product;

pouring a molten metal into a casting mold after the casting mold has been clamped; and drawing out the core subsequently to solidification of the molten metal, breaking the closure member by a drawing force applied to the core.

According to the above-described method, the closure member is broken so that the core is drawn out. Accordingly, since the closure member need not be moved to the non-fitted position, the structure of the casting mold can be simplified.

In the above-mentioned further another mode, the invention provides a method of integrally attaching a hollow member to a cast product by casting so that the hollow member communicates with a hollow interior of the cast product, the method comprising the steps of:

fitting an open end of the hollow member into a recess formed in a core for forming the hollow interior of the cast product, thereby closing the open end of the hollow member;

pouring a molten metal into a casting mold after the casting mold has been clamped; and cutting off the end of the hollow member by a drawing force applied to the core subsequently to solidification of the molten metal, thereby drawing out the core.

According to the above-described method, the hollow member can directly be fitted to the core without use of the closure member. Furthermore, since the fitted portion of the hollow member is cut off when the core is drawn out, the structure of the casting mold can further be simplified.

In further another mode, the invention provides a method of integrally attaching a hollow member to a cast product by casting so that the hollow member communicates with a hollow interior of the cast product, the method comprising the steps of:

fitting an open end of the hollow member into a groove provided in a core for forming the hollow interior of the cast product and having an open end at a core distal end side, thereby closing the open end of the hollow member;

pouring a molten metal into a casting mold after the casting mold has been clamped; and drawing out the core subsequently to solidification of the molten metal and simultaneously moving the hollow member along the groove so that the end of the hollow member is moved out of the groove through the open end of the groove, thereby releasing the hollow member from the fitting in the core.

According to the above-described method, the hollow member is directly fitted in the core. Furthermore, the hollow member is moved along the groove to get out of the groove through the open end thereof when the core is drawn out, so that the hollow member is released from the fitting in the core. Consequently, since a closure member and a moving mechanism therefor are not required, the structure of the casting mold can be simplified. Additionally, since the hollow member is not cut off, no repair at subsequent steps is required.

This invention will be understood better upon a reading of the following detailed description of the preferred embodiments and claims with reference to the accompanying drawings.

DETAILED DESCRIPTION OF THE PREFERRED EMBODIMENTS

Figure 1A:
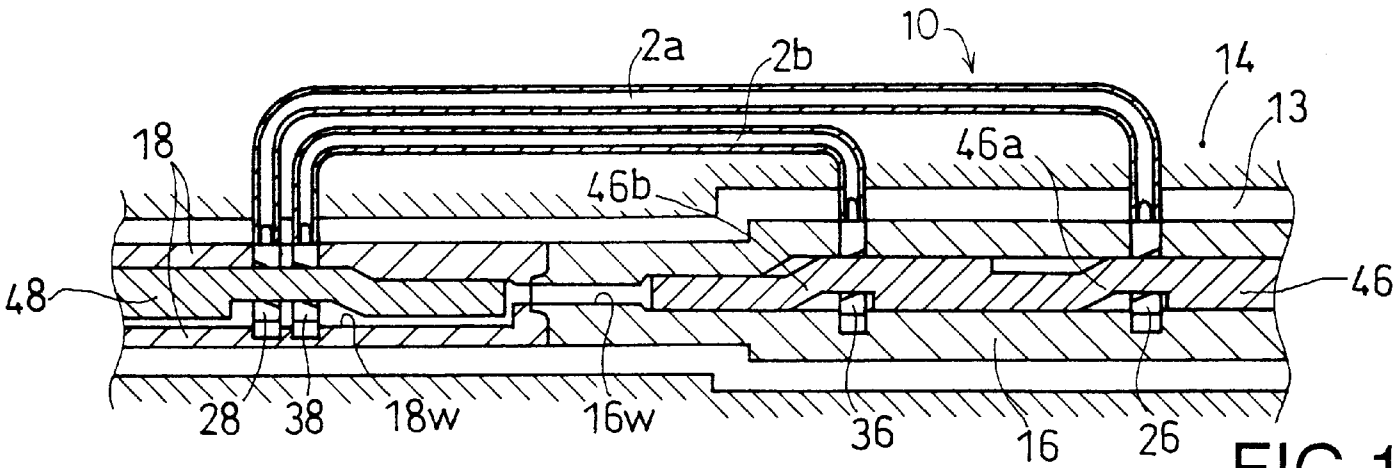
FIG. 1(A) is a partial longitudinal sectional view of a casting apparatus of a first embodiment in accordance with the present invention in which a hollow members 2*a,* 2*b* are integrally attached to a cast product by casting.
Figure 1B:
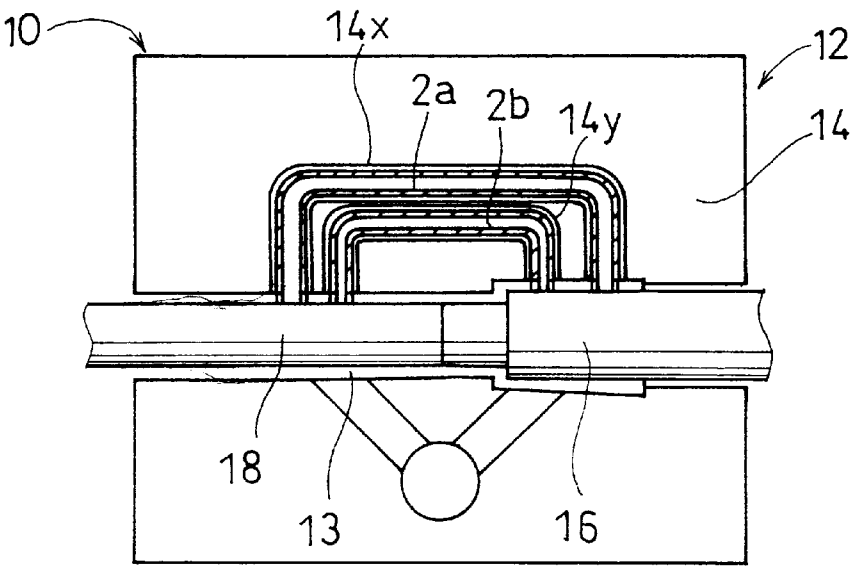
FIG. 1(B) is a front view of a fixed mold of the casting apparatus shown in FIG. 1(A)
Figures 3A, 3B:
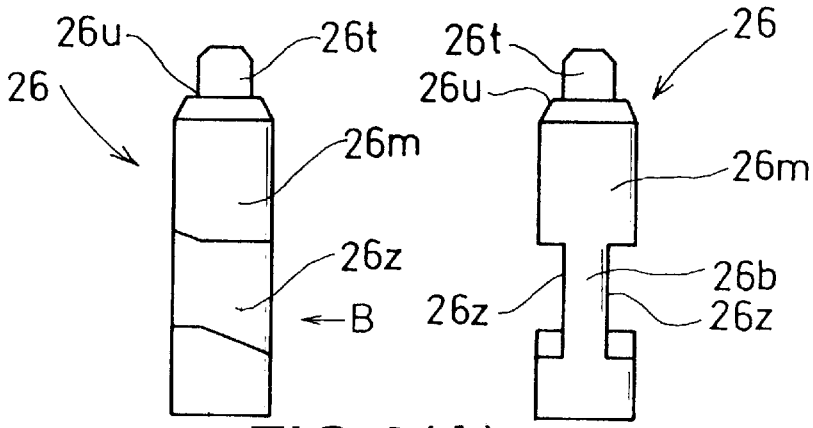
FIG. 3(A) illustrates the configuration of a closure member in detail.
FIG. 3(B) is a view of the closure member as viewed from an angle of arrow B in FIG. 3(A)
Figure 4A:
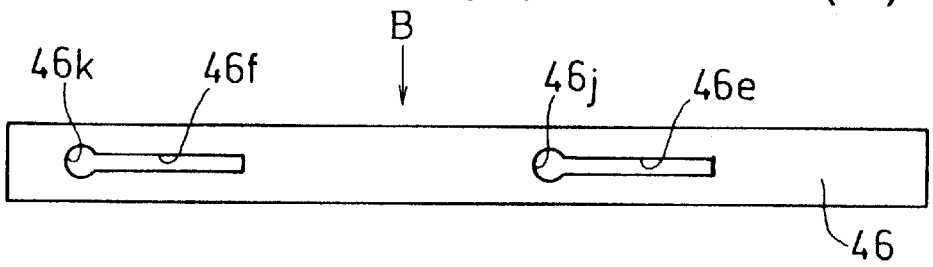
FIG. 4(A) illustrates the configuration of the slide key in detail.
Figure 4B:
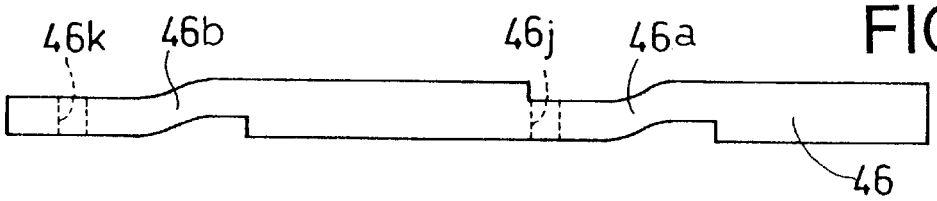
FIG. 4(B) is a view of the slide key as viewed from an angle of arrow B in FIG. 4(A)
Figure 5:
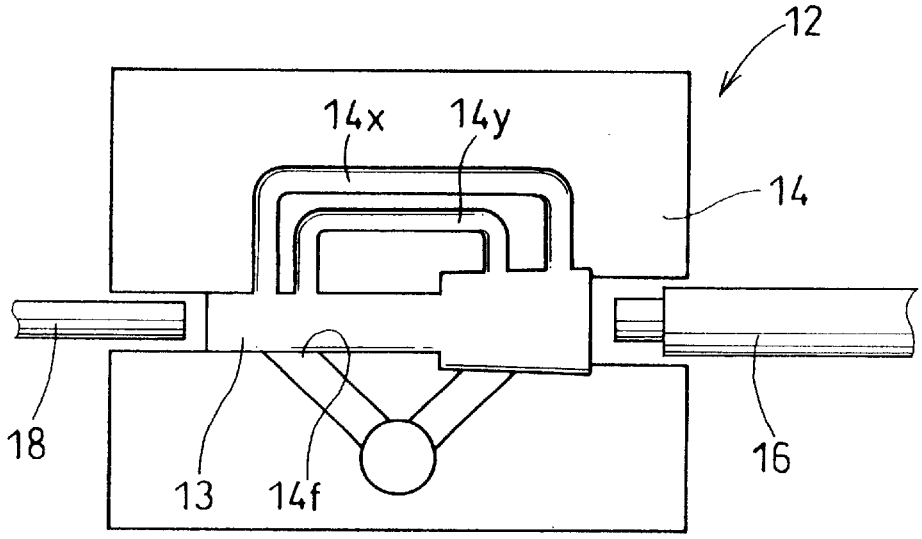
FIG. 5 is a view similar to FIG. 1(B), showing a state before the hollow members are set to a casting mold.

First embodiment:

A first embodiment of the method of integrally attaching a hollow member to a cast product by casting and the apparatus therefor in accordance with the present invention will be described with reference to FIGS. 1(A) to 6(E). FIGS. 1(A) and 1(B) illustrate the casting apparatus. FIGS. 2(A) to 2(D) illustrate a core used with the casting apparatus. FIGS. 3(A) and 3(B) illustrate a closure member used with the casting apparatus. FIGS. 4(A) and 4(B) illustrate the slide key in detail. FIG. 5 illustrates a casting mold used with the casting apparatus. FIGS. 6(A) to 6(E) illustrate an operation or method carried out by the casting apparatus with lapse of time.

Figure 17:
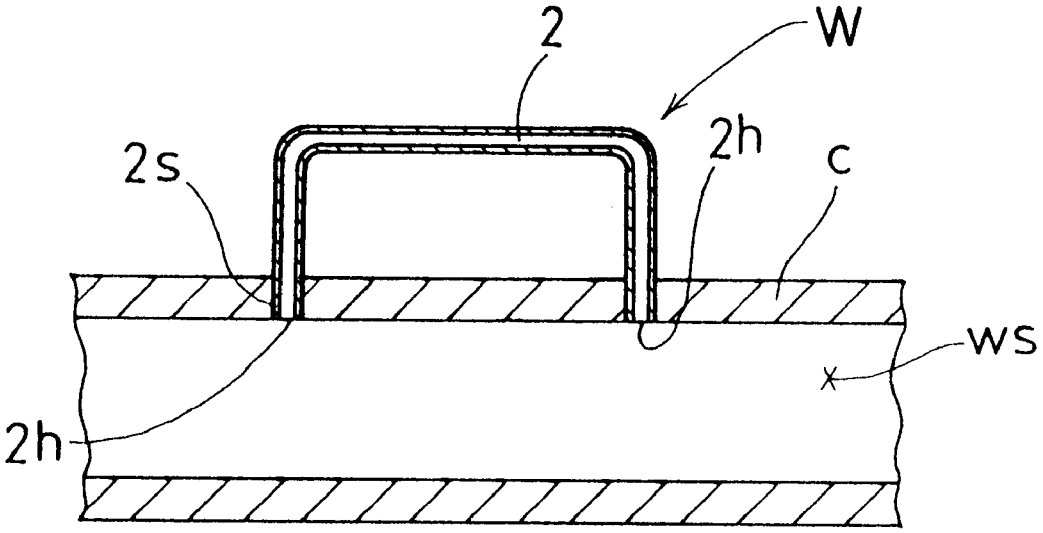
FIG. 17 is a longitudinal sectional view of a product in which a hollow member communicates with a hollow interior of a cast product.
Figure 18:
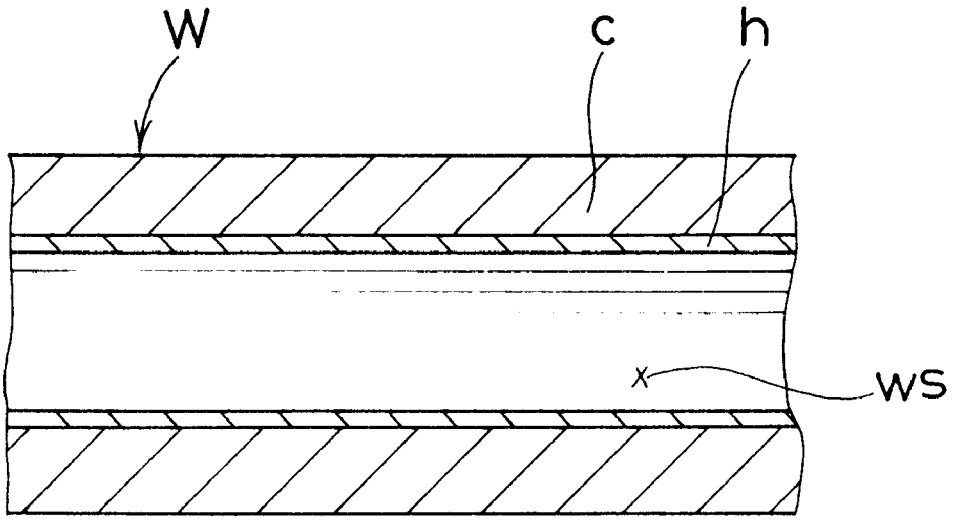
prior art FIG.18
FIG. 18 shows a product in which a hollow member is integrally attached to a cast product by casting.

The casting apparatus carrying out the method produces a product similar to that described with reference to FIG. 17 or a generally cylindrical cast product c with a hollow interior ws. In the embodiment, two hollow members or tubes 2*a* and 2*b* are integrally attached to the cast product c as shown in FIGS. 1(A) to 6(E).

As shown in FIG. 1(B), a casting mold 12 comprises a fixed mold 14 and a moving mold (not shown). FIG. 5 is a front view of the fixed mold 14. The fixed mold 14 has on its center a forming surface 14*f* for forming an external shape of the cast product c. The fixed mold 14 further has two support grooves 14*x* and 14*y* located over the forming surface 14*f* as viewed in FIG. 5. The grooves 14*x* and 14*y* accept for positioning the first and second tubes 2*a* and 2*b* to be integrally attached to the cast product c respectively.

The moving mold (not shown) also has shapes corresponding to the forming surface 14*f* and support grooves 14*x* and 14*y* of the fixed mold 14. The moving mold forms the external shape of the cast product c in cooperation with the fixed mold 14 and positions the first and second tubes 2*a* and 2*b* to be integrally attached to the cast product c. The moving mold is movable in a direction perpendicular to the page space in FIG. 5.

A core for forming a cavity ws in the cast product c comprises first and second slide pins 16 and 18 disposed at both sides of the fixed mold 14 respectively so that center lines of the slide pins 16 and 18 agree with the center line of the forming surface 14*f* of the fixed mold 14. Distal end faces of the first and second slide pins 16 and 18 are interfitted as shown in FIG. 1(B) so that the slide pins 16 and 18 function as a core for forming the hollow interior ws of the cast product c. The slide pins 16 and 18 are moved forward and backward axially or crosswise as viewed in FIG. 5 and FIG. 1(B) when the casting mold 12 is clamped and opened. FIG. 5 shows backward positions of the slide pins 16 and 18. The distal end faces of the first and second slide pins 16 and 18 have the same diameter and are interfitted when the slide pins 16 and 18 are moved forward to respective forward limit positions, as shown in FIG. 1(B).

The first and second slide pins 16 and 18 have axially extending through holes 16*w* and 18*w* respectively as shown in FIG. 1(A). Each of the through holes 16*w* and 18*w* serves both as a cooling water passage and as a space for accommodating a slide key as will be described later. The first and second cooling water passages 16*w* and 18*w* communicate with each other when the distal end faces of the first and second slide pins 16 and 18 are interfitted. Cooling water is adapted to be supplied from a cooling water source (not shown) to the first and second cooling water passages 16*w* and 18*w*. Furthermore, compressed air is supplied from a compressed air source (not shown) to the cooling water passages 16*w* and 18*w* after the cooling water has passed through the first and second cooling water passages 16*w* and 18*w*, so that water drops remaining in the passages can be blown off outward. Accordingly, no circulating cooling water passage need not be provided for each slide pin, and each slide pin can efficiently be cooled uniformly.

Figures 2A, 2B, 2C, 2D:
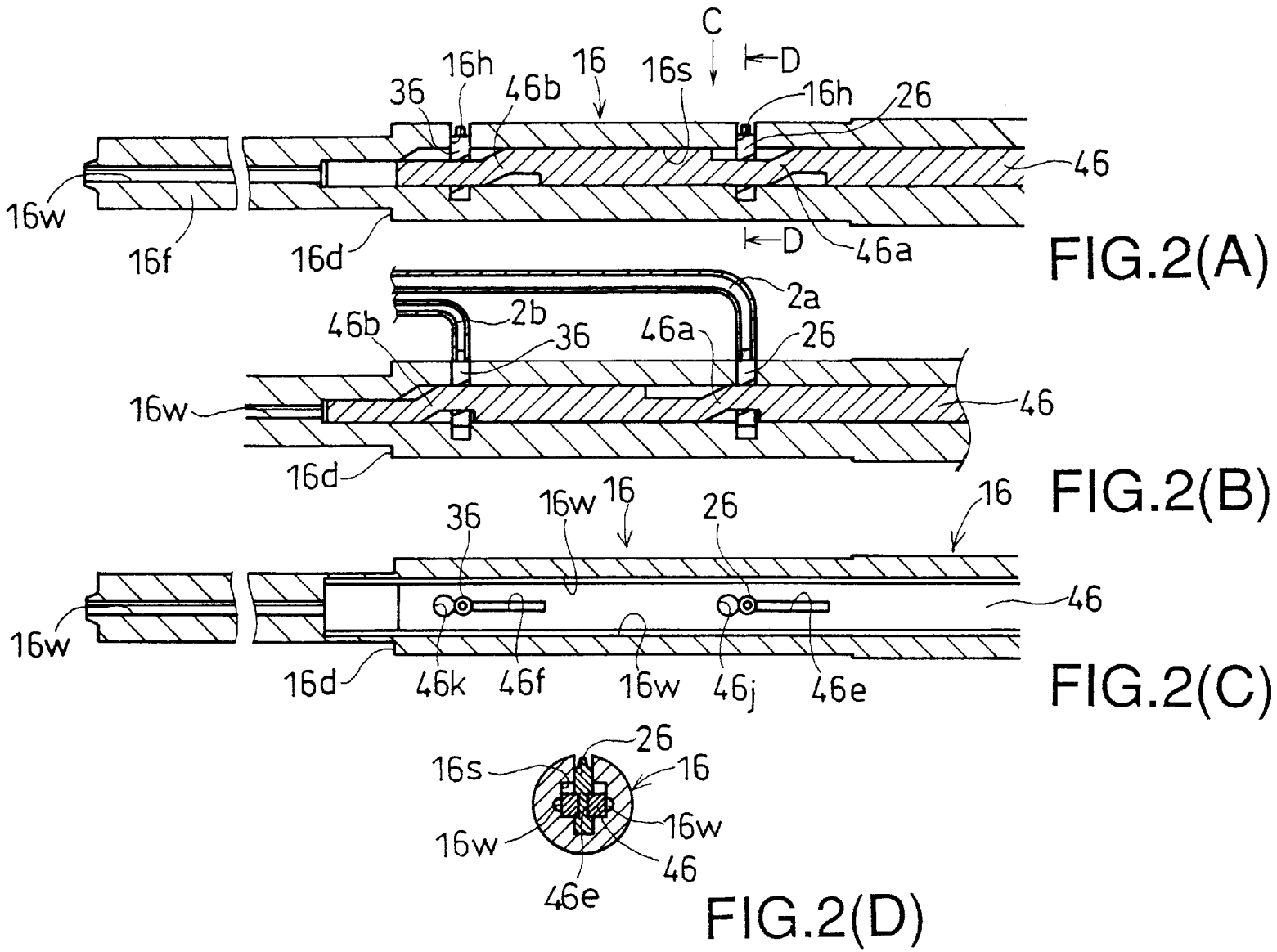
FIG. 2(A) is a detail drawing of a core employed in the casting apparatus shown in FIG. 1(A)
FIG. 2(B) is a detail drawing of the core in which a slide key has been moved forward.
FIG. 2(C) is a view of the core as viewed from an angle of arrow C in FIG. 2(A)
FIG. 2(D) is a sectional view taken along line D—D in FIG. 2(A)

As shown in FIG. 2(A), the first slide pin 16 includes a stepped portion 16*d* and a distal end 16*f* having a slightly small diameter. The first slide pin 16 further has a space 16*s* defined inside to extend axially from the proximal end to the distal end thereof. The space 16*s* has a rectangular section in its portion extending from the proximal end and terminating in the vicinity of the distal end. The space 16*s* further has a circular section in its portion at the distal end 16*f* extending from the portion of the rectangular section. The slide key 46 is accommodated in the rectangular section portion of the space 16*s* to be axially slidable. A pair of grooves 16*w* are formed in both side walls defining the rectangular portion respectively as shown in FIG. 2(D). Spaces defined by the respective grooves 16*w* and the slide key 46 communicate with the water passage 16*w* of the slide pin 16 having the circular section so that both of the spaces and the circular portion serve as the above-described cooling water passage 16*w*.

As shown in FIG. 2(A), the first slide pin 16 has two vertical holes 16*h* formed at predetermined positions communicating with the inner space 16*s*. First and second closure members 26 and 36 are accommodated in the respective vertical holes 16*h* to be vertically slidable. Since the first and second closure members 26 and 36 are formed into the same shape, only the first closure member 26 will be described.

Referring to FIGS. 3(A) and 3(B), the first closure member 26 includes a generally columnar holding portion 26*m* which is adapted to be accommodated in the vertical hole 16*h*. The first closure member 26 further has a pin-like fitting convex portion 26*t* coaxially formed on an upper end face 26*u* of the holding portion 26*m*. The upper end face 26*u* of the holding portion 26*m* has a conically chamfered corner portion. The holding portion 26*m* has two guide grooves 26*z* formed at opposite sides of the center thereof and a flat portion 26*b* between the guide grooves 26*z*.

The fitting convex portion 26*t* of the first closure member 26 has an outer diameter set to be approximately equal to an inner diameter of the first tube 2*a*. The fitting convex portion 26*t* is fitted in the first tube 2*a* with a predetermined clearance therebetween. The upper end face 26*u* of the first closure member 26 has an outer diameter set to be approximately equal to an outer diameter of the first tube 2*a* such that the end face of the first tube 2*a* comes into face-to-face contact with the upper end face 26*u* of the holding portion 26*m*.

The slide key 46 is formed into a strip thick plate and slid in the rectangular portion of the inner space 16*s* shown in FIG. 2(A). The slide key 46 includes first and second inclined portions 46*a* and 46*b* formed to be longitudinally away form each other and each inclined so that the proximal end side is located higher than the distal end side, as shown in FIGS. 2(A), 2(B) and 4(B). The slide key 46 has a first slit 46*e* formed to correspond to the first inclined portion 46*a* and centrally longitudinally extending by a predetermined length. The slide key 46 further has a through hole 46*j* which is formed at a distal end of the first slit 46*e* and through which the first closure member 26 is inserted. The first slit 46*e* has such a width that the flat portion 26*b* of the first closure member 26 is permitted to pass therethrough.

In engaging the first closure member 26 in the first slit 46*e* of the slide key 46, the through hole 46*j* of the slide key 46 is overlapped with the vertical hole 16*h* of the first slide pin 16. The first closure member 26 is then caused to pass through the vertical hole 16*h* and through hole 46*j*. In this condition, the guide groove 26*z* of the first closure member 26 is held parallel to the first slit 46*e*. The slide key 46 is then moved forward so that the first closure member 26 inserted through the through hole 46*j* is relatively moved to the location of the first slit 46*e*, as shown in FIG. 2(C). Consequently, the flat portion 26*b* passes through the first slit 46*e* such that the first closure member 26 is attached to the slide key 46, as best shown in FIG. 2(D).

The first closure member 26 is located in front of the first inclined portion 46*a* when the slide key 46 occupies the backward position, as shown in FIGS. 2(A) and 2(C). Accordingly, the first closure member 26 is held at the lower limit position. Since the first closure member 26 is thus accommodated in the first slide pin 16, the fitting convex portion 26*t* of the first closure member 26 is prevented from radially protruding from the outer surface of the first slide pin 16.

The guide groove 26*z* of the first closure member 26 is located along the first inclined portion 46*a* when the slide key 46 is moved forward, as shown in FIG. 2(B). As a result, the first closure member 26 is raised so that the fitting convex portion 26*t* thereof radially protrudes from the outer surface of the first slide pin 16. In this condition, the fitting convex portion 26*t* of the first slide pin 16 can be fitted with the open end of the first tube 2*a*.

In the same manner, the slide key 46 has a second slit 46*f* formed to correspond to the second inclined portion 46*b* and centrally longitudinally extending by a predetermined length. The slide key 46 further has a through hole 46*k* which is formed at a distal end of the second slit 46*f* and through which the second closure member 36 is inserted. The second slit 46*f* has such a width that the flat portion 36*b* of the second closure member 36 is permitted to pass therethrough. Consequently, the second closure member 36 can be engaged in the second slit 46*f*. The slide key 46 is moved forward and backward in this condition so that the second closure member 36 can be moved upward and downward by the action of the guide groove 36*z* of the second closure member 36 and the second inclined portion 46*b*.

As shown in FIG. 1(A), third and fourth closure members 28 and 38 attached to the second slide pin 18 are attached to the slide key 48 in the same manner as described above, whereupon the slide key 48 is moved forward and backward so that the third and fourth closure members 28 and 38 can be moved upward and downward. The above-described slide keys 46 and 48, and vertical holes 16*h* and 18*h* formed in the first and second slide pins 16 and 18 constitute moving means for moving the closure members 26, 36, 28 and 38 up and down.

Figure 6A:
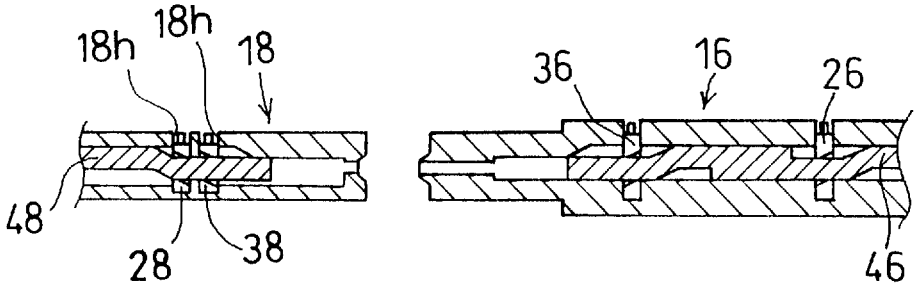
FIG. 6(A) illustrates a first stage of an operation of the casting apparatus shown in FIG. 1(A)
Figure 6B:
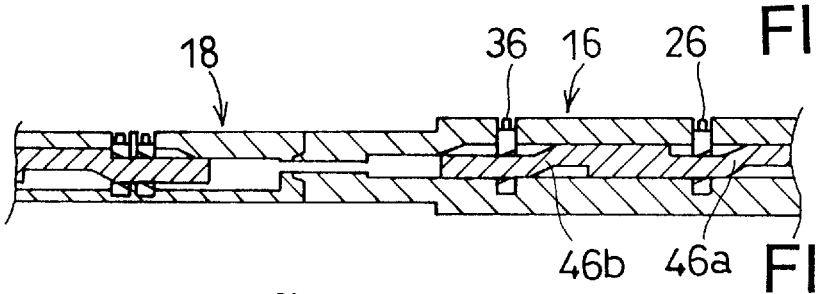
FIG. 6(B) illustrates a second stage of the operation.

The method or operation of the first embodiment will now be described with reference to FIGS. 6(A) to 6(E). First, in the condition of FIG. 6(A) where the casting mold is open, the first and second slide pins 16 and 18 are moved forward so that the end faces of both slide pins are interfitted as shown in FIG. 6(B). The slide key 46 of the first slide pin 16 is then moved forward so that the first and second closure members 26 and 36 follow the first and second inclined portions 46*a* and 46*b* of the slide key 46, whereby the closure members 26 and 36 are moved upward to radially protrude from the outer surface of the first slide pin 16. Furthermore, the slide key 48 of the second slide pin 18 is moved forward so that the third and fourth closure members 28 and 38 follow the inclined portion 48*a* of the slide key 48, whereby the closure members 28 and 38 are moved upward to radially protrude from the outer surface of the second slide pin 18.

Figure 6C:
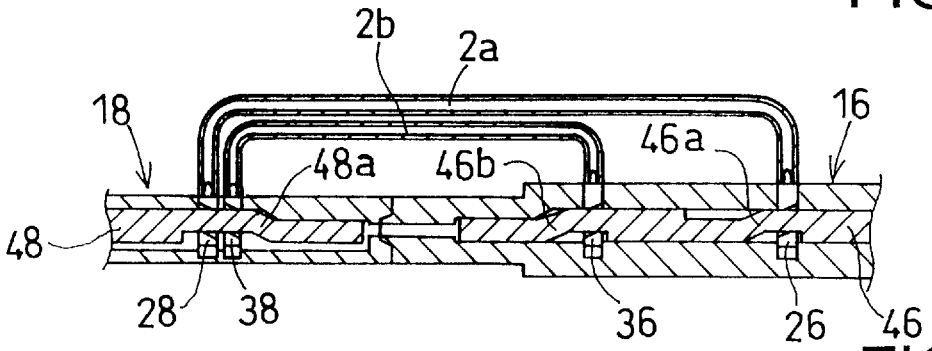
FIG. 6(C) illustrates a third stage of the operation.
Figure 6D:
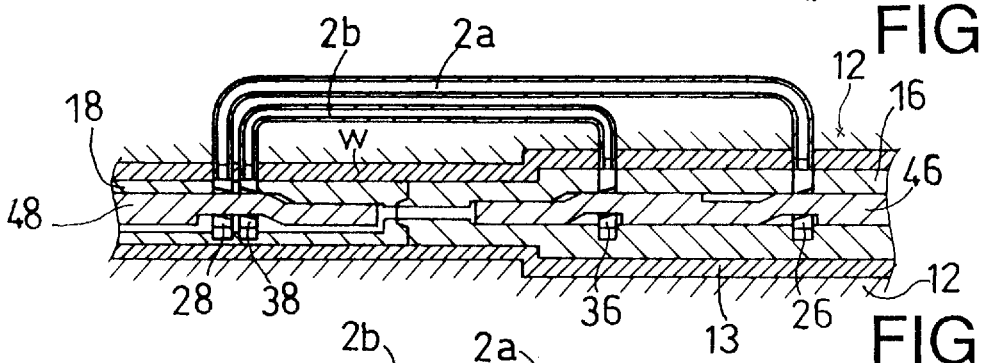
FIG. 6(D) illustrates a fourth stage of the operation.
Figure 6E:
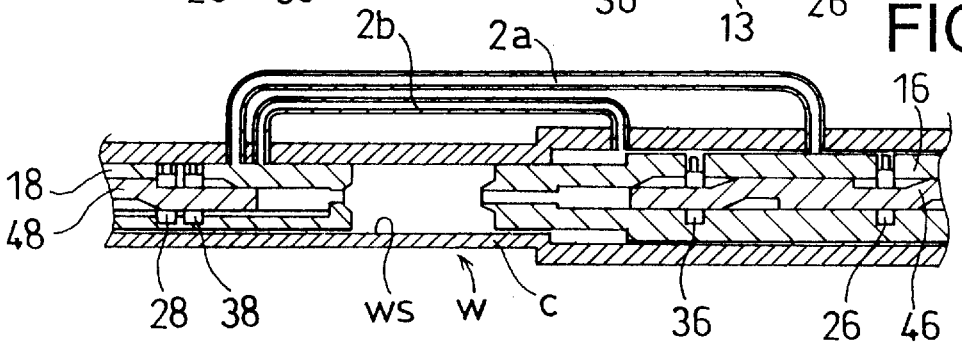
FIG. 6(E) illustrates a fifth stage of the operation.
Figure 7A:
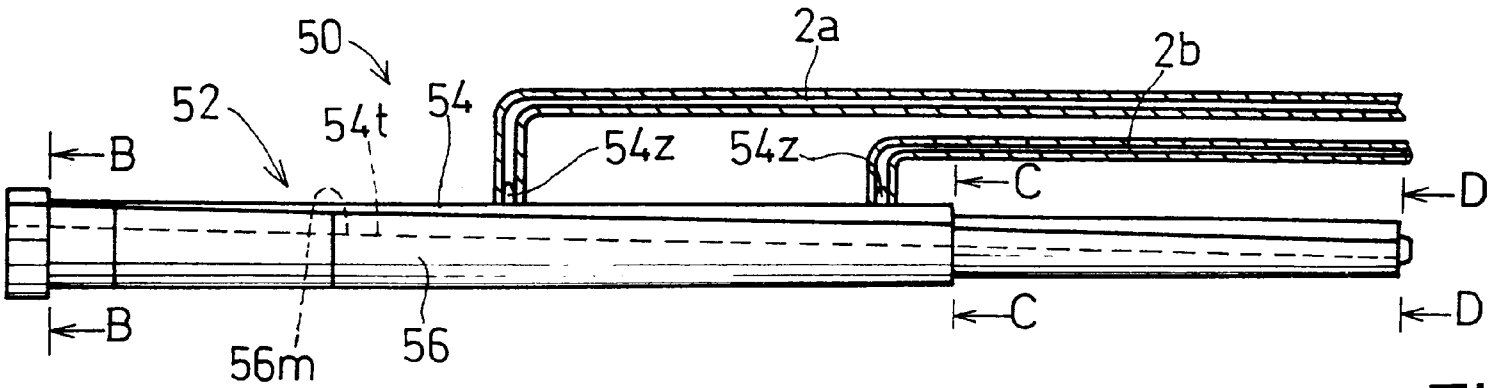
FIG. 7(A) is a detailed view of a core employed in a second embodiment in accordance with the invention.
Figures 7B, 7C, 7D:
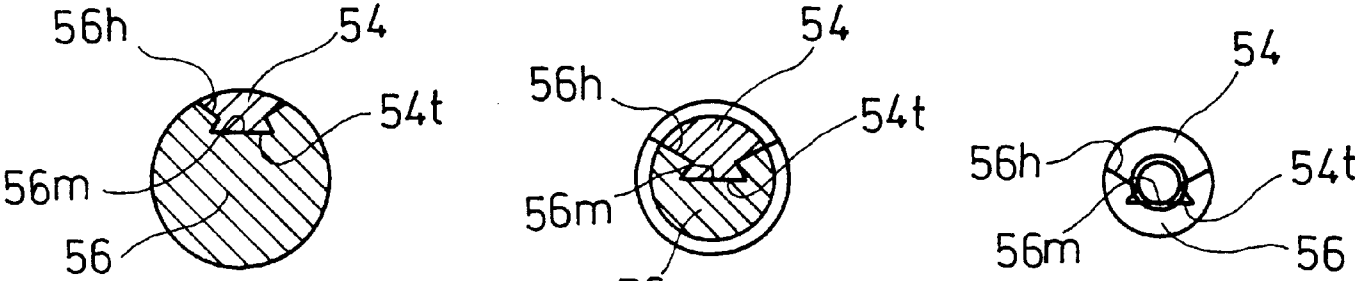
FIG. 7(B) is a sectional view taken along line B—B in FIG. 7(A)
FIG. 7(C) is a sectional view taken along line C—C in FIG. 7(A)
FIG. 7(D) is a sectional view taken along line D—D in FIG. 7(A)

Under the condition where the first to fourth closure members 26, 36, 28 and 38 protrude from the first and second slide pins 16 and 18, the first tube 2*a* is set in the first support groove 14*x* of the fixed mold 14, and the fitting convex portions 26*t* and 28*t* of the first and third closure members 26 and 28 are fitted in the open ends of the first tube 2*a*. Furthermore, the second tube 2*b* is set in the second support groove 14*y* of the fixed mold 14, and the fitting convex portions 36*t* and 38*t* of the second and fourth closure members 36 and 38 are fitted in the open ends of the second tube 2*b*, as shown in FIG. 6(C).

The first and second slide pins 16 and 18 are thus fitted in the first and second tubes 2*a* and 2*b*. Thereafter, the moving mold is moved so that the casting mold is clamped such that the cavity 13 is defined in the casting mold 12 as shown in FIGS. 1(A) and 1(B). Molten metal is forced into the cavity 13. See FIG. 6(D).

A filling completion signal is delivered when the cavity 13 is filled up by the molten metal. In response to the filling completion signal, the cooling water is supplied from the cooling water source to the first and second cooling water passages 16*w* and 18*w* of the first and second slide pins 16 and 18, thereby cooling the slide pins 16 and 18. The supply of cooling water is interrupted after the cooling water is supplied through the first and second slide pins 16 and 18 for a predetermined period of time. Compressed air is subsequently supplied from the compressed air source to the slide pins 16 and 18 so that water drops remaining in the first and second slide pins 16 and 18 are blown off outward.

The molten metal in the cavity 13 is thus solidified such that the cast product c is formed. Then, the casting mold 12 is opened. The slide keys 46 and 48 of the first and second slide pins 16 and 18 are moved backward so that the first to fourth closure members 26, 36, 28 and 38 are moved downward to be accommodated in the first and second slide pins 16 and 18. As a result, the first and third closure members 26 and 28 are released from the fitting in the first tube 2*a*. Furthermore, the second and fourth closure members 36 and 38 are released from the fitting in the second tube 2*b*. The first and second slide pins 16 and 18 are then drawn out of the cast product c such that the hollow interior ws is formed in the cast product c. See FIG. 6(E). The product W in which the first and second tubes 2*a* and 2*b* are integrally attached to the cast product c is taken out of the casting mold 12.

According to the method of and apparatus of the first embodiment, the first to fourth closure members 26, 36, 28 and 38 are fitted in the open ends of the first and second tubes 2*a* and 2*b* to close these open ends. Casting operation is executed under this condition. Consequently, the molten metal can be prevented from penetrating the interiors of the first and second tubes 2*a* and 2*b*. Furthermore, casting operation is executed under the condition where the ends of the first and second tubes 2*a* and 2*b* are positioned by the first to fourth closure members 26, 36, 28 and 38. Additionally, the first to fourth closure members 26, 36, 28 and 38 can be released from the fit in the ends of the first and second tubes 2*a* and 2*b* after the molten metal has been solidified. Consequently, the first and second slide pins 16 and 18 can be drawn out of the cast product c without being obstructed by the first to fourth closure members 26, 36, 28 and 38. More specifically, even when the ends of the first and second tubes 2*a* and 2*b* need to be disposed in the cavity, the tubes can be integrally attached to the cast product c in such a manner that the molten metal is prevented from penetrating the tubes. Furthermore, the first and second slide pins 16 and 18 are not obstructed by the first to fourth closure members 26, 36, 28 and 38 used to close the open ends of the first and second tubes 2*a* and 2*b* when the slide pins 16 and 18 are drawn out.

Second embodiment:

FIGS. 7(A) to 7(D) illustrate a core and closures of a second embodiment in accordance with the invention. In the shown core 50, an upper split pin 54 and a lower split pin 56 both constituting the slide pin 52 are axially slidable relative to each other so that the closure members 54*z* is radially moved by a force resulting from the relative sliding movement.

The upper and lower split pins 54 and 56 are closely interfitted so as to serve as the generally columnar slide pin 52 which is used as a core. Although a single slide pin 52 is shown in FIGS. 7(A) to 7(D), a pair of coaxially disposed slide pins 52 are butted against each other in actual casting.

The upper split pin 54 composes an upper outer face and has a generally sectorial section. The upper split pin 54 has a projection 54*t* formed on a pivot thereof and having a trapezoidal section. The projection 54*t* axially extends from the distal end to the proximal end of the upper split pin 54. A sectional area of the upper split pin 54 is large at the distal end side and small at the proximal end side. The projection 54*t* is gradually upwardly inclined from the distal end to the proximal end of the slide pin 52.

The lower split pin 56 having a circular arc section composes side and lower outer surfaces of the slide pin 52. The lower split pin 56 has on the upper side thereof a concave portion 56*h* which has a sectorial section and into which the upper split pin 54 is to be fitted. The concave portion 56*h* has a larger sectional area at the distal end side of the slide pin 52 and a smaller sectional area at the proximal end side thereof so that the concave portion conforms to the configuration of the slide pin 52. The lower split pin 56 has at a sectorial pivot of the concave portion 56*h* a groove 56*m* which has a trapezoidal section and with which the projection 54*t* of the upper split pin 54 is to be engaged. The groove 56*m* is also upwardly inclined from the distal end to the proximal end of the slide pin 52 according to the projection 54*t* of the upper split pin 54.

In the above-described structure, the projection 54*t* of the upper split pin 54 is inserted into the groove 56*m* of the lower split pin 56 from the distal end side thereof, so that the upper split pin 54 is closely fitted in the concave portion 56*h* of the lower split pin 56. Consequently, the generally columnar slide pin 52 as described above is formed. The projection 54*t* of the upper split pin 54 is moved so as to be drawn out of the groove 56*m* of the lower split pin 56, so that the upper split pin 54 is downwardly displaced by the action of the inclined surfaces of the projection 54*t* and groove 56*m*.

The upper split pin 54 has two closure members 54*z* which are formed at predetermined positions on the outer side surface thereof for closing the open ends of the first and second tubes 2*a* and 2*b*. The projection 54*t* of the upper split pin 54 and the groove 56*m* of the lower split pin 56 constitute the means for moving the closure members 54*z*.

The method of the second embodiment will now be described. First, the upper split pin 54 is closely fitted in the concave portion 56*h* of the lower split pin 56 so that the slide pin 52 is formed. Both slide pins 52 are then moved forward so that the distal ends thereof are interfitted. The first tube 2*a* is set in the first support groove of the fixed mold (not shown) in this condition, and the closure member 54*z* is fitted in the open end of the first tube 2*a*. In the same manner, the second tube 2*b* is set in the second support groove and the closure member 54*z* is fitted in the open end of the second tube 2*b*. When the first and second tubes 2*a* and 2*b* are thus set on the slide pins 52, the moving mold is moved so that the casting mold is clamped. The molten metal is forced into the cavity defined in the casting mold.

The lower split pins 56 of the slide pins 52 are moved backward after the molten metal has been solidified. Consequently, the projections 54*t* of the upper split pins 54 are relatively drawn out of the grooves 56*m* of the lower split pins 56, so that the upper split pins 54 are downwardly displaced by the action of the inclined surfaces of the projections 54*t* and the grooves 56*m*, respectively. As a result, the closure members 54*z* of the upper split pins 54 are pulled out of the open ends of the first and second tubes 2*a* and 2*b*. In other words, the lower split pins 56 of the slide pins 52 are drawn out of the cast product such that the closure members 54*z* of the upper split pins 54 can automatically be released from the fitting in the first and second tubes 2*a* and 2*b*.

The casting mold is then opened and the slide pins 52 are drawn out of the casting. Consequently, the product W is formed with the hollow interior. The product W having the cast product and the integrally attached first and second tubes 2*a* and 2*b* is taken out of the casting mold.

In the slide pin 52 used in the embodiment, the closure members 54*z* of the upper split pin 54 are downwardly moved by the action of the projection 54*t* of the upper slide pin 54 and the inclined surface of the groove 56*m* of the lower split pin 56. Consequently, the construction of the closure member moving means can be simplified and accordingly, the reliability and the maintenance efficiency of the apparatus can be improved. Furthermore, since the slide pin 52 is of the split type, the cooling efficiency can be improved.

Figure 8:
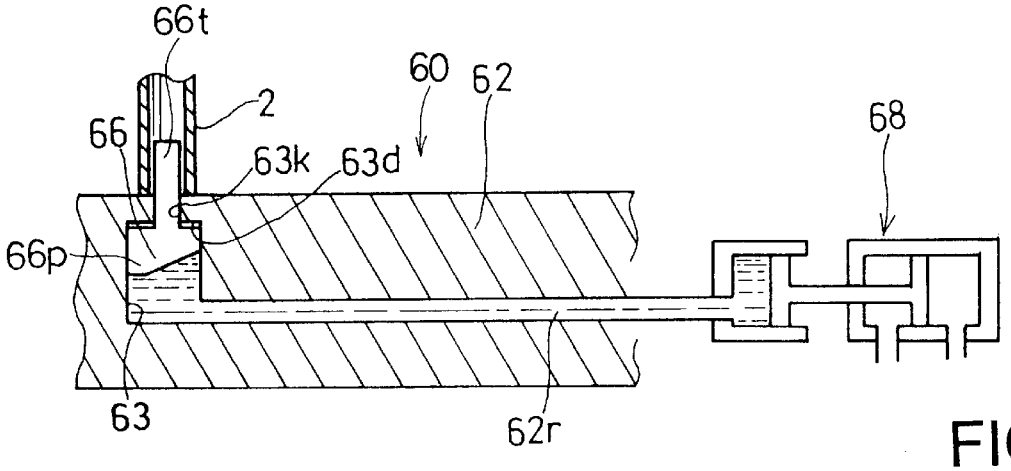
FIG. 8 is a partial longitudinal sectional view of a core employed in a third embodiment in accordance with the present invention.

Third embodiment:

FIG. 8 illustrates a core 60 used in a third embodiment of the invention. In the third embodiment, hydraulic oil pressure is used to displace a closure member 66 radially with respect to the core 60. The closure member 66 includes a piston section 66*p* and a pin-like fitting convex portion 66*t* coaxially fixed on an upper end face of the piston section 66*p*. The fitting convex portion 66*t* has such a diameter that the fitting convex portion is permitted to be fitted in the tube 2 to be integrally attached to the cast product. The piston section 66*p* of the closure member 66 has a lower end face which is inclined so that the piston section is apt to be subjected to an oblique hydraulic oil pressure.

The piston section 66*p* of the closure member 66 is accommodated in a cylinder section 63 formed in the interior of a slide pin 62. The cylinder section 63 is formed to extend radially (vertically in FIG. 8) with respect to the slide pin 62. A ceiling 63*d* of the cylinder section 63 has a coaxial through hole 63*k* through which the fitting convex portion 66*t* of the closure member 66 extends. A spring (not shown) is provided between the ceiling 63*d* of the cylinder section 63 and the upper end face of the piston section 66*p* of the closure member 66. The spring is urged in a direction in which the closure member 66 is pushed downward.

A hydraulic oil passage 62*r* extending from a pressure device 68 is connected to the lower end of the cylinder section 63. Accordingly, the closure member 66 is pushed upward to an upper limit position against a spring force when the atmosphere in the cylinder section 63 is pressurized by the pressure device 68. On the other hand, when the pressure in the cylinder section 63 is reduced, the spring force pushes the closure member 66 downward to a lower limit position. The length of the fitting convex portion 66*t* is set so that the convex portion 66*t* projects by a predetermined length from the outer surface of the slide pin 62 when the closure member 66 occupies the upper limit position and so that the convex portion 66*t* is accommodated in the slide pin 62 when the closure member 66 occupies the lower limit position.

In setting the tube 2 on the slide pin 62, the interior of the cylinder section 63 is pressurized by the pressure device 68. Consequently, the closure member 66 is pushed upward to the upper limit position against the spring force so that the fitting convex portion 66*t* of the closure member 66 projects by the predetermined length from the outer surface of the slide pin 62. In this condition, the convex portion 66*t* is fitted in the open end of the tube 2.

The pressure in the interior of the cylinder section 63 is reduced by the pressure device 68 when the convex portion 66*t* is released from the fitting in the tube 2 after solidification of the molten metal. Consequently, the closure member 66 is pushed downward to the lower limit position by the spring force so that the convex portion 66*t* is drawn out of the end of the tube 2.

According to the apparatus of the third embodiment, the closure member 66 is moved radially with respect to the slide pin 62 by the hydraulic oil pressure. Accordingly, only the hydraulic oil passage 62*r* needs to be provided between the cylinder section 63 for moving the closure member 66 and the pressure device 68. Consequently, the mechanism for moving the closure member can be rendered more compact as compared with the case where the closure member is mechanically moved. Thus, the mechanism of the third embodiment can be applied to small slide pins.

Figure 9A:
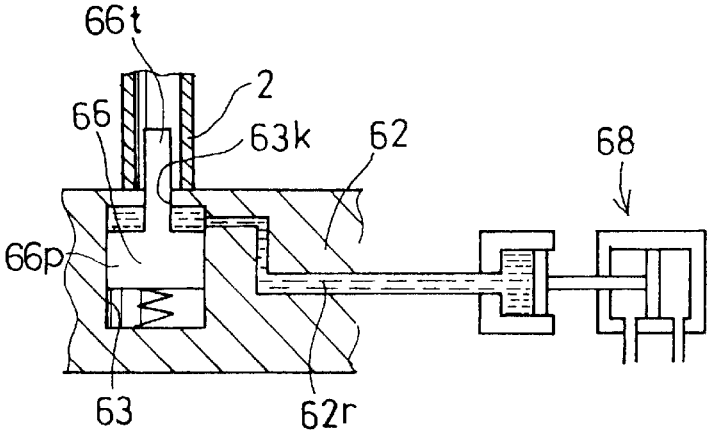
FIG. 9(A) is a partial detailed view of a core employed in a fourth embodiment in accordance with the present invention.
Figure 9B:
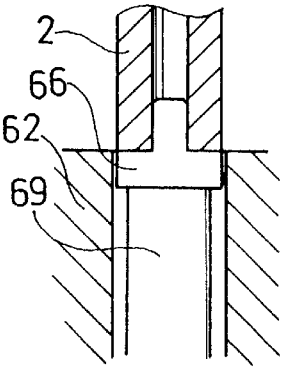
FIG. 9(B) is a detailed view of a closure member employed in the fourth embodiment.

Fourth embodiment:

FIGS. 9(A) and 9(B) illustrate a fourth embodiment of the invention. As shown in FIG. 9(A), the hydraulic oil passage 62*r* is connected to the upper end of the cylinder section 63. The spring is provided between the bottom of the cylinder section 63 and the lower face of the piston section 66*p*. In this construction, the closure member 66 can be pushed upward to the upper limit position by the spring force and pushed downward to the lower limit position by the hydraulic oil pressure. Furthermore, pneumatic pressure or hydraulic pressure may be used to move the closure member 66 upward and downward, instead of the hydraulic oil pressure. The cooling water piping can be utilized to also serve as the hydraulic pressure piping. Additionally, an extruding pin 69 may be used to move the closure member 66 upward and downward as shown in FIG. 9(B).

Figure 10A:
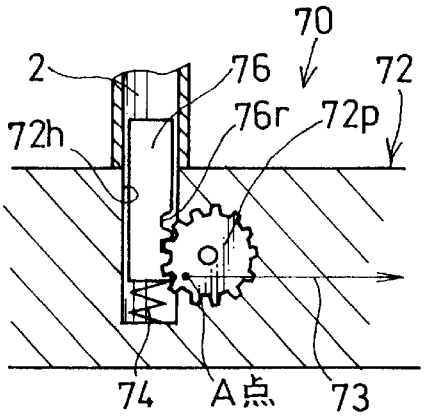
FIG. 10(A) is a partial detailed view of a core employed in a fifth embodiment in accordance with the present invention.
Figure 10B:
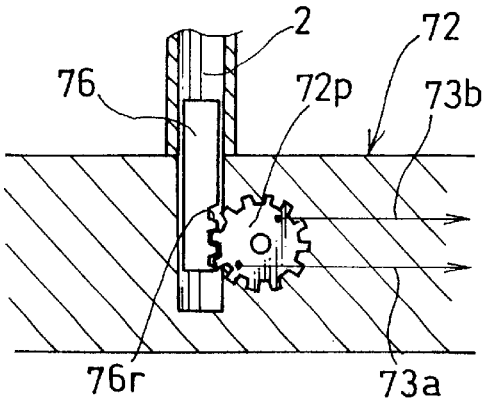
FIG. 10(B) is a partial detailed view of a modified form of the core.

Fifth embodiment:

FIGS. 10(A) and 10(B) illustrate a core used in a fifth embodiment of the invention. In the fifth embodiment, a rack-and-pinion mechanism is used as the closure member moving means. As shown in FIG. 10(A), the closure member 76 is slidably accommodated in a deep hole 72*h* formed in the slide pin 72 to extend radially (vertically in the figure) with respect to the slide pin. The closure member 76 has a vertical rack 76*r* formed on the side thereof. A pinion 72*p* meshed with the rack 76*r* is provided in the slide pin 72 in position. A wire 73 is connected to point A on the pinion 72*p*. The pinion 72*p* can be rotated counterclockwise about 90 degrees when the wire 73 is pulled toward the proximal end of the slide pin 72 (to the right in FIG. 10(A)), whereupon the closure member 76 is moved downward.

The spring 74 is provided between the underside of the closure member 76 and the bottom of the deep hole 72*h* and urged so that the closure member 76 projects from the slide pin 72. Accordingly, the closure member 76 is held at the upper limit position with the distal end thereof projecting by a predetermined length from the outer surface of the slide pin 72 when no tensile force is applied to the wire 73. In this condition, when a tensile force is applied to the wire 73 so that the pinion 72*p* is rotated counterclockwise about 90 degrees, the closure member 76 can be moved downward to the lower limit position against the force of the spring 74 by the action of the rack-and-pinion. Furthermore, the rotation angle of the pinion 72*p* can be adjusted by the tensile force applied to the wire 73, and the value of the tensile force can indicate the position of the closure member 76. The distal end of the closure member 76 has such a diameter as to be permitted to be fitted in the tube 2 to be insert cast.

In setting the tube 2 on the slide pin 72, the wire 73 is released from the tensile force applied thereto. As a result, the spring 74 pushes the closure member 76 upward to the upper limit position such that the distal end of the closure member 76 projects by the predetermined length from the outer surface of the slide pin 72. In this condition, the distal end of the closure member 76 is fitted in the end of the tube 2.

The tensile force is applied to the wire 73 so that the pinion 72*p* is rotated counterclockwise about 90 degrees when the closure member 76 is released from the fitting in the tube 2 after solidification of the molten metal. As a result, the closure member 76 is pushed downward to the lower limit position against the spring 74 so that the closure member 76 is accommodated in the slide pin 72 and the distal end thereof is drawn out of the end of the tube 2.

According to the apparatus of the fifth embodiment, the rotation angle of the pinion 72*p* can be adjusted by the tensile force applied to the wire 73, and the value of the tensile force can indicate the position of the closure member 76.

FIG. 10(B) shows the construction in which the pinion 72*p* is rotated about 90 degrees clockwise and counterclockwise by two wires 73*a* and 73*b*. This construction eliminates the spring 74 pushing the closure member 76 upward. Accordingly, the closure member 76 need not be pushed downward against the force of the spring 74 when moved downward. Consequently, the rack-and-pinion mechanism can be prevented from being subjected to a large force.

Although the pinion 72*p* is rotated by the tensile force of the wire in the fifth embodiment, a chain, gears, etc. may be used, instead.

Figure 11A:
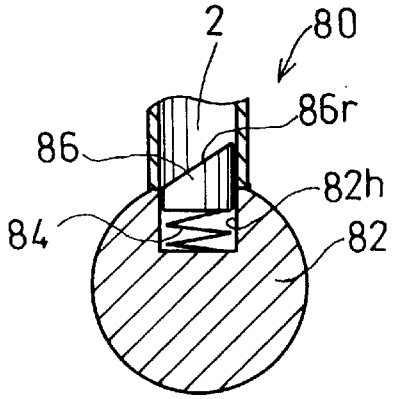
FIG. 11(A) is a partial detailed view of a core employed in a sixth embodiment.
Figure 11B:
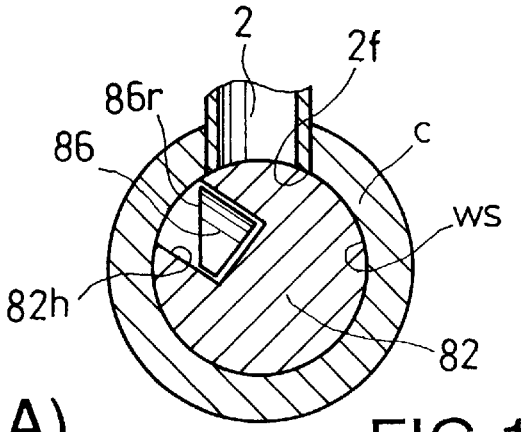
FIG. 11(B) illustrates the core in a state different from that in FIG. 11(A)

Sixth embodiment:

FIGS. 11(A) and 11(B) illustrate a core used in a sixth embodiment of the invention. In the sixth embodiment, an inclined surface 86*r* formed on the distal end of the closure member 86 serves as the closure member moving means. The closure member 86 is a generally columnar pin having such an outer diameter as to be fitted in the tube 2. The upper end face of the closure member 86 serves as the inclined surface 86*r* having a predetermined inclination. The closure member 86 is slidably accommodated in the deep hole 82*h* formed to extend radially with respect to the slide pin 82. The spring 84 accommodated in the hole 82*h* applies to the closure member 86 a force projecting it from the slide pin 82. A stopper (not shown) is provided in the hole 82*h* for adjusting a maximum amount of projection of the closure member 86. The closure member 86 is usually adjusted so that the inclined surface 86*r* thereof projects from the slide pin 82. More specifically, the closure member 86 projects radially with respect to the slide pin 82 by the height of the inclined surface 86*r*, and this projecting portion is fitted in the tube 2 to be integrally attached to the cast product. The slide pin 82 is rotatable by a predetermined angle about its axis. The inclined surface 86*r* of the closure member 86 is positioned so that the direction thereof agrees with the direction of rotation of the slide pin 82. Accordingly, when the slide pin 82 is rotated in the condition where the closure member 86 projects from the outer surface of the slide pin 82, the inclined surface 86*r* of the closure member 86 follows the distal end face 2*f* of the tube 2 and the inner wall surface of the cast product c to be accommodated in the hole 82*h* of the slide pin 82.

According to the sixth embodiment, the slide pin 82 is rotated so that the inclined surface 86*r* of the closure member 86 is forced to follow the distal end face 2*f* of the tube 2, whereby the closure member 86 fitted in the tube 2 is drawn out. Consequently, the mechanism for moving the closure member can be rendered further more compact.

Seventh embodiment:

FIGS. 12(A) to 12(D) illustrate a core and closure member used in a seventh embodiment of the invention. A collapsible closure member 96 is used in the apparatus of the seventh embodiment so that the closure member need not be moved when the casting mold is opened.

Figure 12A:
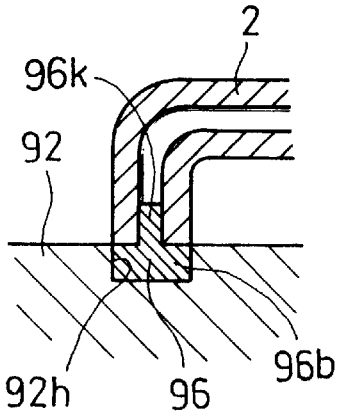
FIG. 12(A) is a partial detailed view of a core employed in a seventh embodiment in accordance with the present invention.
Figure 12B:
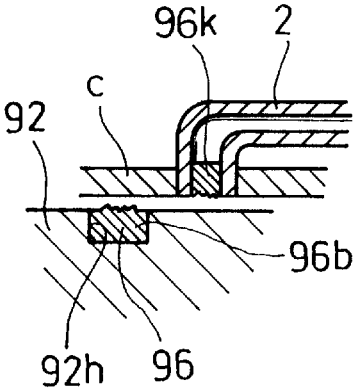
FIG. 12(B) illustrates the core in the broken state in a seventh embodiment.

The closure member 96 comprises a base portion 96*b* fixed to the slide pin 92 and a fitting convex portion 96*k* to be fitted in the tube 2. The base portion 96*b* is accommodated in a recess 92*h* formed in a predetermined position of the outer surface of the slide pin 92 to thereby be fixed. Since the closure member 96 is collapsible and fixed in position, the closure member is directly subjected to a force of drawing out the slide pin 92 to be collapsed when the slide pin 92 is drawn out after solidification of the molten metal, as shown in FIG. 12(B). As a result, the slide pin 92 drawn out is not obstructed by the closure member 96.

According to the seventh embodiment, a mechanism need not be provided for moving the closure member 96 to the position where the slide pin 92 drawn out of the cast product c is not obstructed by the closure member 96. Consequently, the structure of the apparatus can be simplified. Sand etc. is suitable for a material of the collapsible closure member 96.

Figure 12C:
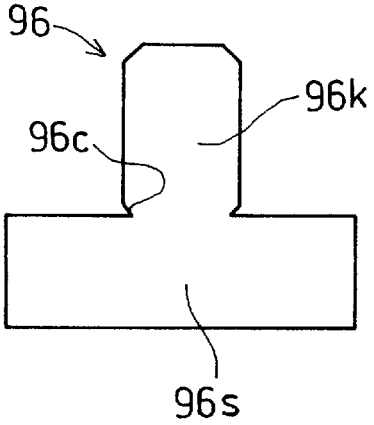
FIG. 12(C) is a partial detailed view of a closure member employed in the seventh embodiment.

FIG. 12(C) shows the closure member 96 formed of a metal. In this case, a slitting 96*c* is provided at a boundary between the fitting convex portion 96*k* and the base portion 96*b* so that the closure member 96 can reliably be cut off at the slitting 96*c*.

Figure 12D:
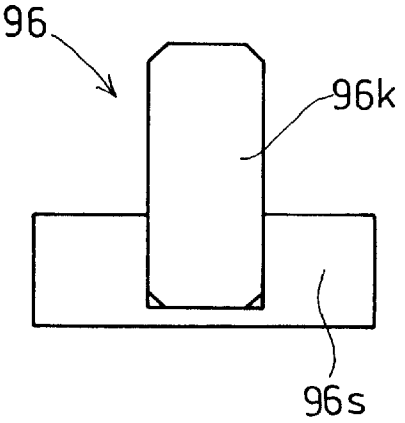
FIG. 12(D) is a partial detailed view of another closure member employed in the seventh embodiment.

FIG. 12(D) shows the closure member 96 including the fitting convex portion 96*k* formed of a material having a small strength and the base portion 96*b* formed of a material having a large strength. Consequently, the closure member 96 can reliably be cut off at the fitting convex portion 96*k*. A part of the collapsed closure member remaining in the tube 2 can suitably be eliminated at a subsequent step.

Figure 13A:
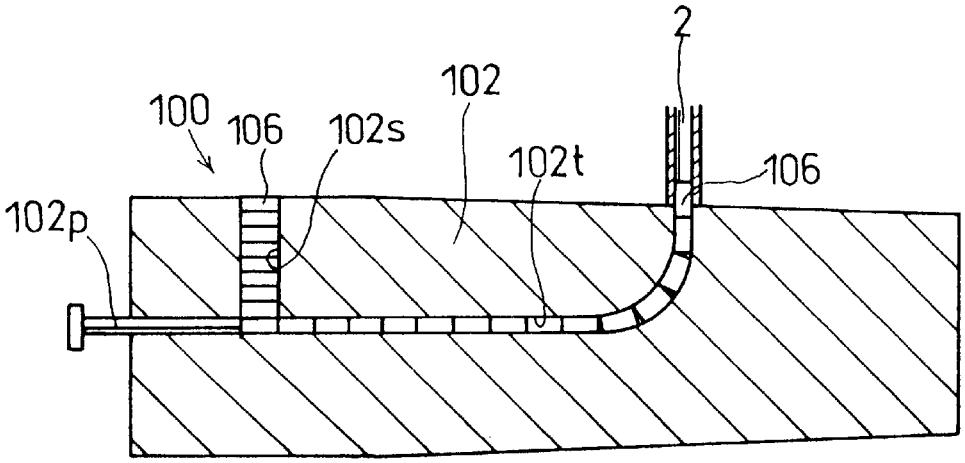
FIG. 13(A) is a partial detailed view of a core employed in an eighth embodiment in accordance with the present invention.
Figure 13B:
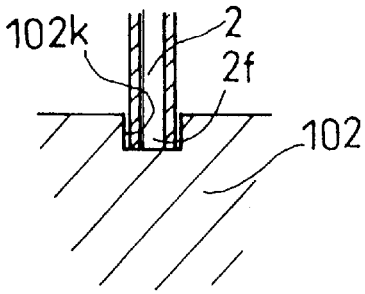
FIG. 13(B) is a partial detailed view of a modified form of the core in the eighth embodiment.
Figure 14A:
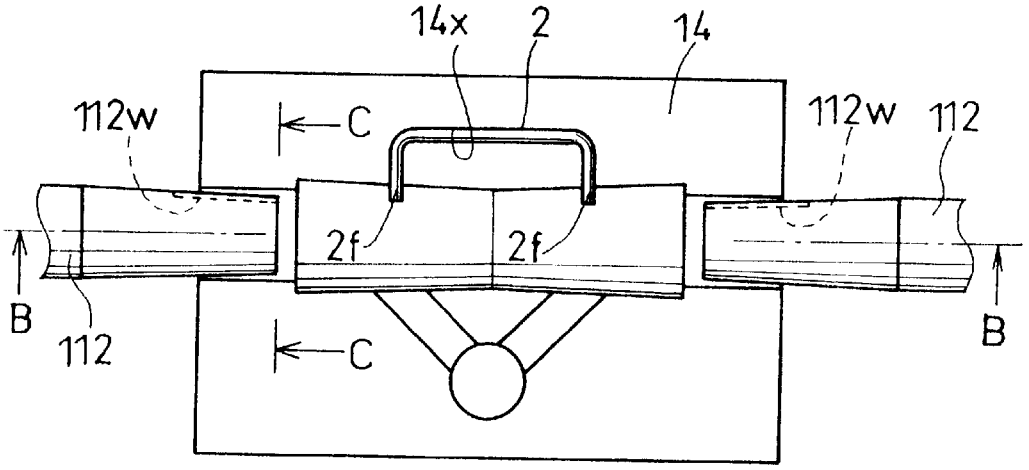
FIG. 14(A) is a partial front view of a casting apparatus of a ninth embodiment in accordance with the present invention.
Figure 14B:
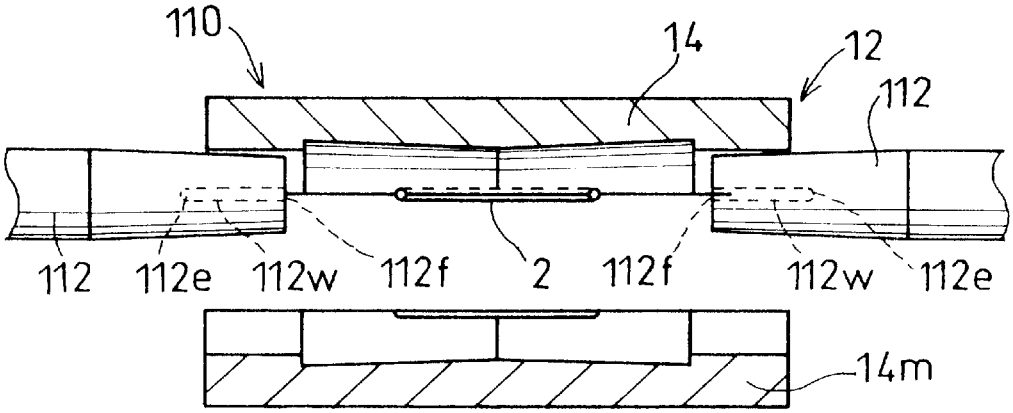
FIG. 14(B) is a partial plan view of the apparatus shown in FIG. 14(A)
Figure 14C:
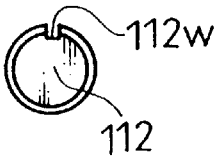
FIG. 14(C) is a sectional view taken along line C—C in FIG. 14(A)

Eighth embodiment:

FIGS. 13(A) and 13(B) illustrate a core used in the eighth embodiment of the invention. In the apparatus 100 of the embodiment, the collapsible closure member 106 can be set at a predetermined position on the outer surface of the slide pin 102 through a passage 102*t* formed inside the slide pin 102.

The passage 102*t* is formed to be slightly larger than the closure member 106 and extends axially from the proximal end of the slide pin 102. The passage 102*t* is bent upward by 90 degrees at a predetermined curvature in the vicinity of the distal end of the slide pin 102 and open at a predetermined position on the outer surface of the slide pin.

A closure member feed pin 102*p* is slidably inserted in an end of the passage 102*t* at the proximal end side. A vertical closure member supply passage 102*s* is formed within a sliding movement of the closure member feed pin 102*p* so as to cross the passage 102*t*. The closure member supply passage 102*s* has a width set to be approximately equal to the length of the closure member 106 and a thickness set to be approximately equal to an outer diameter of the closure member 106. Accordingly, the closure members 106 are accommodated in the closure member supply passage 102*s* to be parallel to the passage 102*t* in the condition where the closure members are stacked one upon another in the closure member supply passage.

One closure member 106 is supplied to the passage 102*t* from the closure member supply passage 102*s* when the closure member feed pin 102*p* is pulled toward the proximal end side over the closure member supply passage 102*s*. In this condition, the closure member feed pin 102*p* is pushed in to the position where the pin closes the closure member supply passage 102*s*, whereby the closure member 106 supplied to the passage 102*t* can be pushed further into the passage 102*t* by a distance equal to the length of the closure member.

Thus, the closure member feed pin 102*p* is repeatedly pulled out and pushed in alternately so that the closure members 106 can be supplied into the passage 102*t* one by one. The first supplied closure member 106 projects by the predetermined length from the outer surface of the slide pin 102 when reaching the opening of the passage 102*t*. In this condition, the closure member feed pin 102*p* is held at the position. Thus, when the first supplied closure member 106 is held in the condition where it projects from the outer surface of the slide pin 102, the tube 2 is set on the closure member 106 and thereafter, casting operation is executed. When the molten metal is solidified and the slide pin 102 is drawn out, the closure member 106 is subjected to a drawing force in the process of drawing out the slide pin 102 to thereby be collapsed.

In execution of the subsequent casting, the closure member feed pin 102*p* is pulled out and pushed in once so that one closure member 106 is supplied into the passage 102*t*, and the second supplied closure member 106 is caused to project from the outer surface of the slide pin 102 with fragments of the former closure member being pushed out of the passage.

According to the eighth embodiment, the closure member feed pin 102*p* is only reciprocated so that the closure member is set at the predetermined position on the slide pin 102. Consequently, a time required for setting the closure member can be shortened.

Although the collapsible closure member 106 is used for closing the distal end of the tube 2 and for positioning the tube in the embodiment, the distal end 2*f* of the tube 2 may be formed of a collapsible material and may be fitted in a recess 102*k* formed at a predetermined position on the outer surface of the slide pin 102, as shown in FIG. 13(B). As a result, the tube 2 can be closed and positioned, too. In this case, when only a portion of the tube 2 buried in the recess 102*k* is formed of the collapsible material, a non-collapsible tube communicating with the hollow interior of the cast product can be integrally attached to the cast product.

Ninth embodiment:

FIGS. 14(A) to 15(B) illustrate an apparatus of a ninth embodiment. In the apparatus 110 of the ninth embodiment, axially extending rectangular grooves 112*w* having rectangular sections are formed on the upper outer surfaces of a pair of slide pins 112 respectively as shown in FIG. 14(C). The distal end 2*f* of the tube 2 is fitted in the rectangular grooves 112*w*. Each rectangular groove 112*w* has a width slightly larger than the distal end 2*f* of the tube 2 so that the distal end 2*f* is accommodated in each rectangular groove. Furthermore, the bottom of each rectangular groove 112*w* is formed to be flat so as to close the distal end of the tube 2.

In connecting the tube 2 to each slide pin 112, the tube 2 is set in the support groove 14*x* of the fixed mold 14. Both slide pins 112 are then moved forward. The distal end 2*f* of the tube 2 is fitted into the entrances 112*f* of the rectangular grooves 112*w* formed on the slide pins 112 in the course of the forward movement of the slide pins 112 to be relatively moved following the rectangular grooves 112*w*. The distal end 2*f* of the tube 2 is moved to the proximal end 112*e* of the rectangular groove 112*w* when the distal ends of the slide pins 112 are abutted against each other, so that the fitting is completed.

Figure 15A:
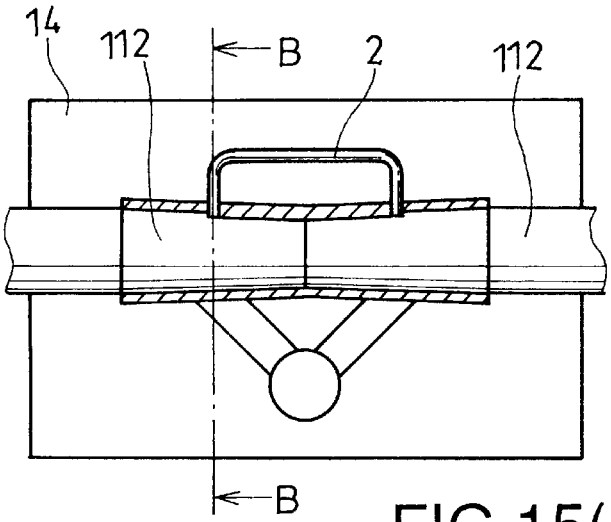
FIG. 15(A) is a partial front view of the apparatus shown in FIG. 14(A)
Figure 15B:
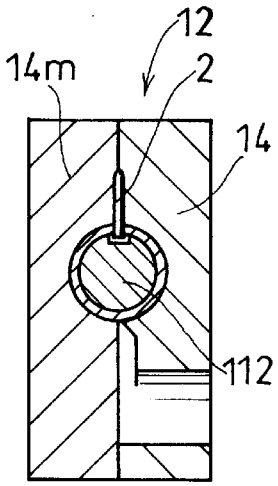
FIG. 15(B) is a sectional view taken along line B—B in FIG. 15(A)

The moving mold 14*m* is moved so that the casting mold 12 is clamped, and the molten metal is forced into the cavity after the tube 2 is fitted in the slide pins 112, as shown in FIGS. 15(A) and 15(B). The distal end 2*f* of the tube 2 located at the proximal end 112*e* of the rectangular groove 112*w* is moved, following the rectangular groove 112*w* when both slide pins 112 are drawn out after solidification of the molten metal. As a result, the distal end 2*f* is automatically detached from the entrance 112*f* of the rectangular groove 112*w*.

According to the ninth embodiment, the tube 2 is directly fitted in the slide pins 112. Furthermore, when the casting mold is opened, the tube 2 is released from the fitting in the slide pins 112, being moved along the rectangular groove 112*w*. Consequently, no closure member and the moving mechanism for the closure member are required, and the structure of the casting mold can be simplified. Furthermore, since the tube 2 is not cut off, no repair is required in a subsequent step.

Figure 16A:
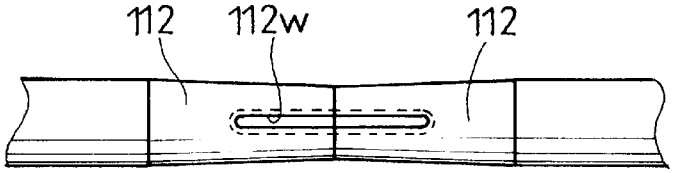
FIG. 16(A) is a partial plan view of a core employed in a tenth embodiment in accordance with the present invention.
Figure 16C:
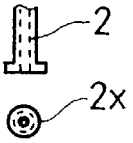
FIG. 16(C) illustrates a configuration of a distal end of a hollow member employed in the tenth embodiment.
Figure 16B:
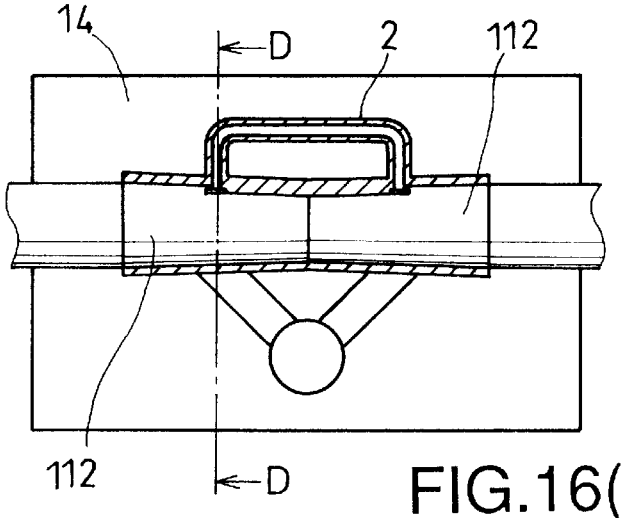
FIG. 16(B) is a partial front view of a casting apparatus of the tenth embodiment.
Figure 16D:
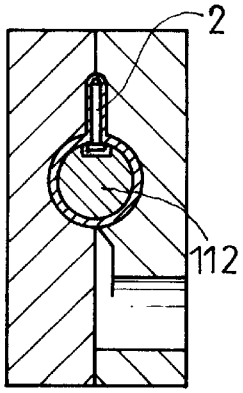
FIG. 16(D) is a sectional view taken along line D—D in FIG. 16(B)
Figure 16E:
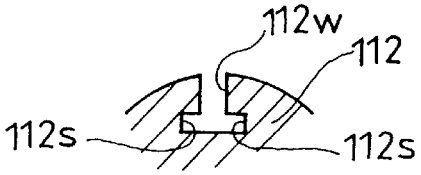
FIG. 16(E) shows an enlarged view of a groove of the core in the tenth embodiment.

Tenth embodiment:

FIGS. 16(A) to 16(E) illustrate a modified form of the apparatus of a tenth embodiment. The tube 2 has a flange 2*x* on the distal end thereof, as shown in FIG. 16(C). Side grooves 112*s* in which the flange 2*x* is fitted are formed on side walls of the rectangular groove 112*w* of the slide pin 112, as shown in FIG. 16(E).

According to the tenth embodiment, the tube 2 is prevented from being axially displaced in the condition where the distal end 2*f* of the tube 2 is fitted in the rectangular groove 112*w* of the slide pin 112. Furthermore, the distal end of the tube 2 is reliably closed by the bottom of the rectangular groove 112*w*.

According to the present invention, the hollow member can be integrally attached to the cast product with the molten metal being prevented from penetrating the interior of the hollow member even when the end of the hollow member needs to be disposed in the cavity of the casting mold. Furthermore, the closure member closing the open end of the hollow member does not obstruct the core being drawn out of the cast product. Consequently, since the sand core etc. need not be used, the casting cost can be reduced.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

What is claimed is:

1. A method of integrally attaching a hollow member to a cast product by casting so that the hollow member communicates with a hollow interior of the cast product, the method comprising the steps of:

fitting a closure member into an open end of the hollow member so that the open end of the hollow member is closed by the closure member, the closure member projecting from a core for forming the hollow interior of the cast product in a direction different from a direction in which the core is drawn out of the cast product;

pouring a molten metal about the core, closure member and fitted hollow member;

moving the closure member inside the core after solidification of the molten metal so that the closure member is released from the fitting in the hollow member; and drawing the core out of the solidified metal subsequently to the moving step of the closure member.

2. A method of integrally attaching a hollow member to a cast product by casting so that the hollow member communicates with a hollow interior of the cast product, the method comprising the steps of:

fitting a closure member into an open end of the hollow member so that the open end of the hollow member is closed by the closure member, the closure member projecting from a core for forming the hollow interior of the cast product in a direction different from a direction in which the core is drawn out of the cast product;

pouring a molten metal about the core, closure member and fitted hollow member;

drawing out the core subsequently to solidification of the molten metal, breaking the closure member by a drawing force applied to the core.

3. A method of integrally attaching a hollow member to a cast product by casting so that the hollow member communicates with a hollow interior of the cast product, the method comprising the steps of:

fitting an open end of the hollow member into a recess formed in a core for forming the hollow interior of the cast product, thereby closing the open end of the hollow member;

pouring a molten metal about the core and fitted hollow member; and cutting off the end of the hollow member by a drawing force applied to the core subsequently to solidification of the molten metal, thereby drawing out the core.

4. A method of integrally attaching a hollow member to a cast product by casting so that the hollow member communicates with a hollow interior of the cast product, the method comprising the steps of:

fitting an open end of the hollow member into a groove provided on a core for forming the hollow interior of the cast product, the groove having an open end at a core distal end side;

pouring a molten metal about the core and fitted hollow member; and drawing out the core subsequently to solidification of the molten metal and simultaneously moving the hollow member along the groove so that the end of the hollow member is moved out of the groove through the open end of the groove, thereby releasing the hollow member from the fitting with the core.

5. An apparatus for integrally attaching a hollow member to a cast product by casting so that the hollow member communicates with a hollow interior of the cast product, the apparatus comprising:

a core for forming the hollow interior of the cast product;

a closure member to be fitted into an open end of the hollow member so that the open end of the hollow member is closed by the closure member, the closure member projecting from the core in a direction different from a direction in which the core is drawn out of the cast product;

means for moving the closure member from a fitted position to a non-fitted position; and means for drawing out the core.

6. An apparatus according to claim 5, wherein the closure member moving means has a slide key formed with an inclined surface with which the closure member is engaged, the slide key being moved so that the closure member is moved between the fitted position and the non-fitted position.

7. An apparatus according to claim 5, wherein the closure member moving means moves the closure member to the non-fitted position by a fluid pressure.

8. An apparatus according to claim 5, wherein the closure member moving means includes a rack-and-pinion for moving the closure member to the non-fitted position.

9. An apparatus according to claim 5, wherein the closure member moving means includes an inclined surface formed on a distal end of the closure member to be fitted in the hollow member and the core is rotatable so that the closure member is moved to the non-fitted position by the rotation of the core.

* * * * *